United States Patent [19]

Galloway

[11] 4,391,467

[45] Jul. 5, 1983

[54] SYSTEM FOR PRODUCING A UNIFORM RUBBLE BED FOR IN SITU PROCESSES

[75] Inventor: Terry R. Galloway, Berkeley, Calif.

[73] Assignee: The United States of America as represented by the United States Department of Energy, Washington, D.C.

[21] Appl. No.: 253,125

[22] Filed: Apr. 10, 1981

[51] Int. Cl.[3] ..... E21C 41/10

[52] U.S. Cl. ..... 299/2; 175/53; 175/391; 175/393; 299/90

[58] Field of Search ..... 299/2, 90, 18; 175/53, 175/385, 391, 406, 393

[56] References Cited

U.S. PATENT DOCUMENTS

| | | | |
|---|---|---|---|
| 2,775,439 | 12/1956 | McCarthy | 175/53 |
| 2,800,316 | 7/1957 | Henderson | 299/18 X |
| 3,460,867 | 8/1969 | Cameron et al. | 175/53 X |
| 3,765,722 | 10/1973 | Crumb | 299/2 |
| 3,967,689 | 7/1976 | Cherrington | 175/406 X |

*Primary Examiner*—Ernest R. Purser

*Attorney, Agent, or Firm*—Henry P. Sartorio; Harold M. Dixon; Richard G. Besha

[57] ABSTRACT

A method and a cutter for producing a large cavity filled with a uniform bed of rubblized oil shale or other material, for in situ processing. A raise drill head (72) has a hollow body (76) with a generally circular base and sloping upper surface. A hollow shaft (74) extends from the hollow body (76). Cutter teeth (78) are mounted on the upper surface of the body (76) and relatively small holes (77) are formed in the body (76) between the cutter teeth (78). Relatively large peripheral flutes (80) around the body (76) allow material to drop below the drill head (72). A pilot hole is drilled into the oil shale deposit. The pilot hole is reamed into a large diameter hole by means of a large diameter raise drill head or cutter to produce a cavity filled with rubble. A flushing fluid, such as air, is circulated through the pilot hole during the reaming operation to remove fines through the raise drill, thereby removing sufficient material to create sufficient void space, and allowing the larger particles to fill the cavity and provide a uniform bed of rubblized oil shale.

14 Claims, 4 Drawing Figures

SYSTEM FOR PRODUCING A UNIFORM RUBBLE BED FOR IN SITU PROCESSES

BACKGROUND OF THE INVENTION

The present invention relates in general to mining and energy resources removal, and more particularly to a system for producing a uniform rubble bed for in situ processes. The United States Government has rights in this invention pursuant to Contract No. W-7405-ENG-48 between the U.S. Department of Energy and the University of California.

Various energy resource production and mineral extraction processes may be conducted in situ, including the gasification of coal, the extraction of minerals from an ore, heat storage, and the retorting of oil shale. These processes generally require the creation of an underground cavity filled with a bed of rubble. The rubblized bed provides spaces for the flow of process fluids and provides a large material surface area for contacting process fluids.

Energy production and mineral extraction techniques require the investment of substantial capital. It is therefore important that efficient and economical systems for carrying out the processes be utilized. The cost per unit of production by a specific process can well be the critical factor in determining whether to go into production with the process. In situ processes often reach resources which cannot be obtained economically by other methods. Furthermore, in situ processes are often advantageous in terms of safety and minimum environmental impact.

The in situ processes generally require that the cavity be filled with rubblized material of a uniform size in order to effectively control the process, efficiently remove the resource, and minimize pumping costs. Inert gas processes for the retorting of oil shale using nuclear or solar heat sources are one type of process being developed. A heated inert gas is flowed through a rubblized bed of oil shale to produce shale oil.

The rubblizing of the material produces a greater volume of material because of the spaces between particles. The void space is necessary for process flow. Accordingly, a fraction or the original material must be removed. For example, in an in situ oil shale retorting process, a fraction of the original oil shale material, typically 20%, is removed.

Rubblization can be performed by mining techniques. U.S. Pat. No. 3,661,423 to Donald E. Garrett, patented May 9, 1977, and U.S. Pat. No. 4,017,119 to Arthur E. Lewis, patented Apr. 12, 1977, show mining methods for rubblizing an oil shale deposit for in situ retorting. Rubblization using explosives is an alternative method, illustrated by U.S. Pat. No. 3,593,789 to Michael Prats, issured July 20, 1971.

Mining techniques to prepare a rubblized bed are generally very costly, and also present a relatively high safety risk to the miners who must perform the underground operations. Other techniques such as rubblization using explosives are difficult to control and result in wide variation in particle size, which is undesirable in terms of process efficiency.

It is an object of the present invention to provide a method and a cutter for producing a uniform rubble bed in an under ground cavity.

It is a further object of the present invention to provide an economical and efficient method for producing a uniform rubble bed in an underground cavity.

It is a still further object of the present invention to provide a method and a cutter for producing a uniform rubble bed in an underground cavity wherein a portion of the material is removed.

SUMMARY OF THE INVENTION

The present invention is a method and a raise drill head or cutter for producing an underground cavity filled with a uniform rubble bed. The raise drill head or cutter comprises a hollow body with a generally circular base and sloped upper surface having a plurality of spaced cutter teeth on the upper surface. A hollow shaft is connected to the body and a plurality of holes are formed in the body between the cutter teeth. A plurality of flutes or cutouts around the body allow material to drop the raise head. A pilot hole is formed in a deposit. The pilot hole is reamed using the raise drill head to provide an enlarged cavity producing fines and relatively uniformly sized larger particles. During the reaming operation, a flushing fluid is circulated, generally down the pilot hole and out through the raise drill head, to carry away fines produced by the reaming operation and also to provide cooling of the raise drill head. The larger particles are allowed to fill the cavity, forming a uniform rubble bed.

The pilot hole in the deposit may be provided by drilling a hole from the surface using drilling equipment, or by drilling a pilot hole from an underground passage such as a mine drift or tunnel. Once the pilot hole is completed, it is reamed into a much larger hole to provide the underground cavity by a raise drilling operation wherein a raise drill string projects through the pilot hole and is connected to a large diameter raise head placed in a drift or tunnel at the bottom of the pilot hole. A raise drilling machine is located at the top of the pilot hole. The raise drilling machine rotates the drill string and the attached raise head, and draws it up along the pilot hole to ream the pilot hole into a larger cavity. During this reaming operation, a flushing fluid is circulated through the pilot hole, and preferably out through the raise head, to carry away fines produced by the reaming operation and to cool the raise head. The larger particles produced during the reaming operation drop through the cutouts in the raise head to fill the cavity and provide the rubblized bed.

The foregoing and other aspects of the invention will become apparent from the following detailed description considered in conjunction with the accompanying drawings.

DETAILED DESCRIPTION OF THE PREFERRED EMBODIMENTS

Figure 1:
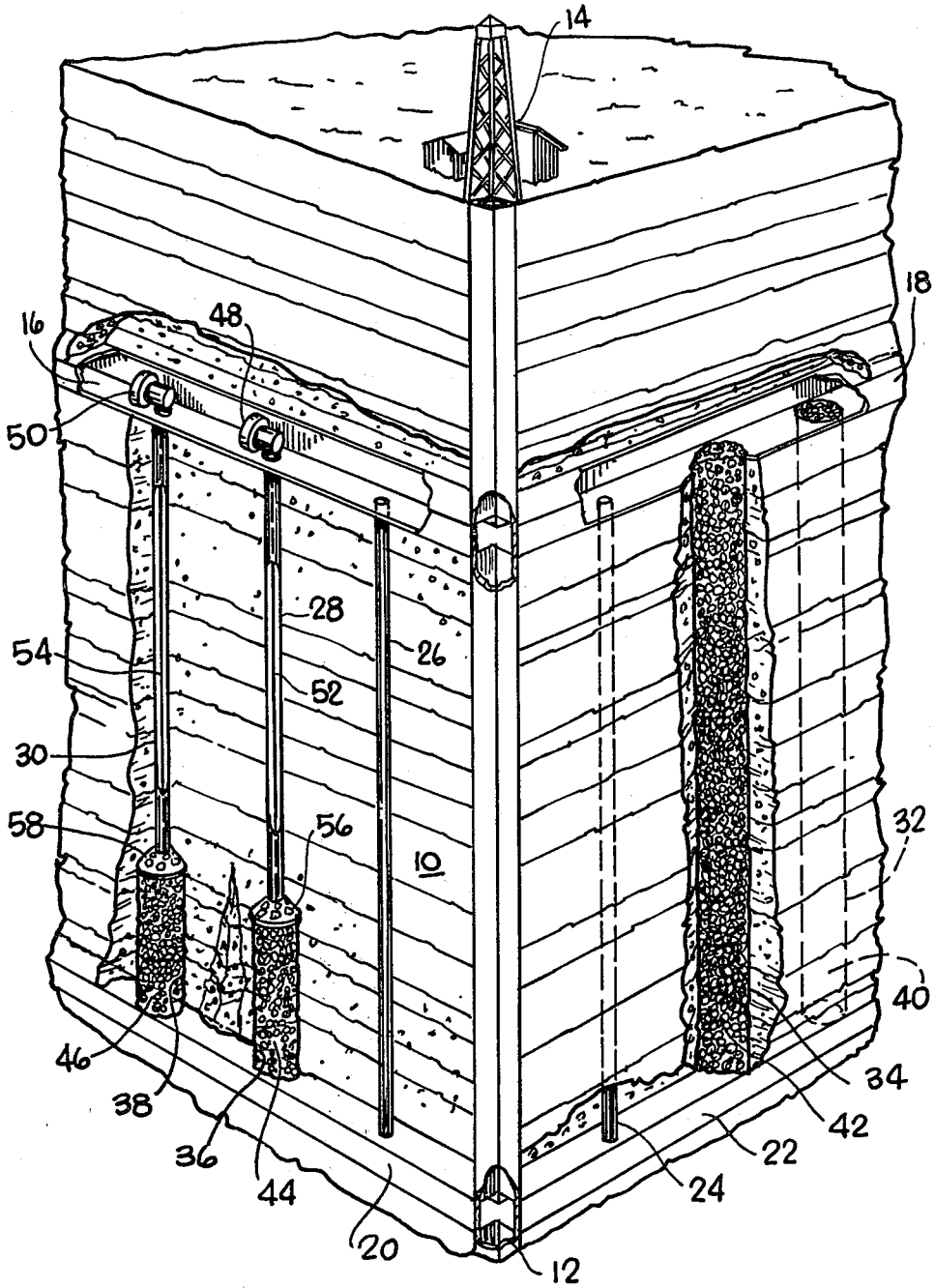
FIG. 1 is a cross sectional view of parallel horizontal tunnels extending through an oil shale deposit, with cavities containing a uniform rubblized bed being formed between the horizontal tunnels.

A cutaway view of an oil shale deposit 10 is illustrated in FIG. 1. A central shaft 12 extends into the oil shale deposit 10. An elevator and various other surface equipment 14 are shown at the top of the shaft 12. Extending from the shaft 12 are two upper level drifts 16 and 18. The two upper level drifts 16 and 18 intercept the shaft 12 to allow equipment to be easily transported to the upper level drifts. A pair of lower level drifts 20 and 22 are located extending from the central shaft below and generally aligned or oriented with the upper level drifts 16 and 18.

The present invention provides a system for producing cavities in the oil shale deposit 10 with the cavities containing a uniform rubblized bed of oil shale. This is accomplished by drilling a pilot hole such as 24 and 26 between the aligned upper and lower level drifts. The pilot holes can be drilled by conventional drilling equipment. They can be drilled from the surface, or they can be drilled from one of the drifts. The pilot holes are typically 16 inches in diameter and 250 feet long. The pilot holes are enlarged into much larger diameter holes such as 36 and 38 by means of large diameter raise heads, 20 feet or more in diameter, to provide retorting cavities filled with rubble, such as 32 and 34.

The system of the present invention allows numerous rubble-filled cavities to be produced between upper and lower level drifts. FIG. 1 shows six different cavity-forming operations in different stages of production. Pilot holes 24 and 26 have been drilled between the upper and lower drifts. The pilot holes 28 and 30 are being reamed by raise heads 56 and 58 into large diameter cavities 36 and 38 containing uniform rubblized beds 44 and 46. Cavities 32 and 34 have been completed and are filled with uniform rubble beds 40 and 42.

The lower level drifts 20 and 22 provide access to the lower end of the pilot holes. This allows the large diameter raise heads to be moved into position at the bottom of the pilot hole. The raise head is transported down the central shaft 12, or down an inclined drift 67 as in FIG. 2, and through a lower level horizontal drift to the lower end of the pilot hole. A drill string is emplaced in the pilot hole and the raise head is attached to the lower end of the raise drill string. As illustrated in FIG. 1, raise drilling machines 48 and 50 are located at the upper end of the pilot holes 28 and 30 in the upper horizontal drift 16. The raise drilling machines 48 and 50 rotate the raise drill strings 52 and 54 and the raise heads 56 and 58 attached thereto, and draw the raise heads 56 and 58 upward along the pilot holes 28 and 30 to ream out a large cavity around the pilot hole. During the raise reaming operation, a flushing fluid such as air is circulated through the pilot holes to carry away fines produced during the raise reaming operations and to cool the cutters. The larger particles produced during the raise reaming operation will fall into the cavity being produced, and provide the rubblized oil shale bed for the retorting operation. Once the rubble-filled cavities are completed, the oil shale is retorted to produce shale oil by introducing a combustion supporting gas and propagating a retorting front down through the shale bed. The oil shale bed may also be processed by nuclear (fission or fusion) or solar heat driven inert gas retorting methods. The rubblized bed for in situ oil shale retoring contains relatively uniform size particles with the optimum size for the particles in the range of 8 to 20 cm. The fines have been removed to create void space in the rubblized bed.

Figure 2:
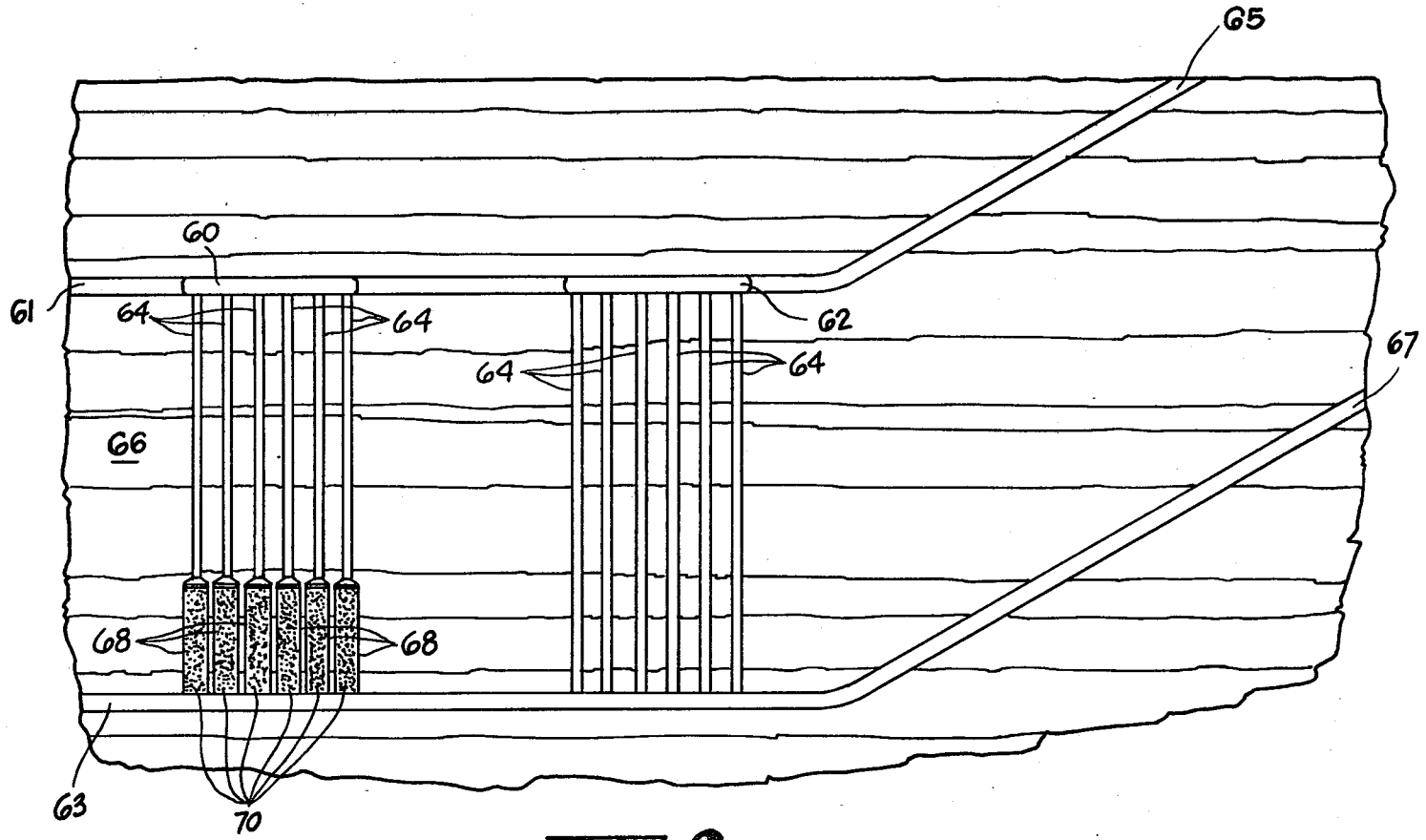
FIG. 2 is an illustrative representation of a system of sequentially producing rubble filled cavities between upper and lower drifts.

A system for sequentially producing numerous cavities containing uniform rubblized beds is shown in FIG. 2. A plurality of moving long wall structures 60 and 62 placed in upper level horizontal drift 61 are utilized, each carrying a base for gang-mounting a plurality of raise drilling machines. Each of the raise drilling machines sequentially drills a pilot hole 64 through the oil shale deposit 66 from upper level drift 61 to lower level drift 63, and reams the pilot hole 64 into a large diameter cavity 68 containing a rubblized bed 70 of oil shale. Counter-rotating drill strings and shoes on the long wall structures 60 and 62 provide the foundation to handle thrust and torque. The illustration of FIG. 2 shows one group of raise drilling machines mounted on structures 62 which have drilled a plurality of pilot holes 64 through the oil shale deposit 66. A second group of raise drilling machines mounted on structure 60 are enlarging the pilot holes previously drilled by the first raise drilling machines. A flushing fluid is circulated through the pilot holes 64 during the reaming operation. This removes the fines being produced during the reaming operation, and allows the larger sized pieces to fall into the cavity being produced to provide the uniform rubblized oil shale bed 70.

Figure 3:
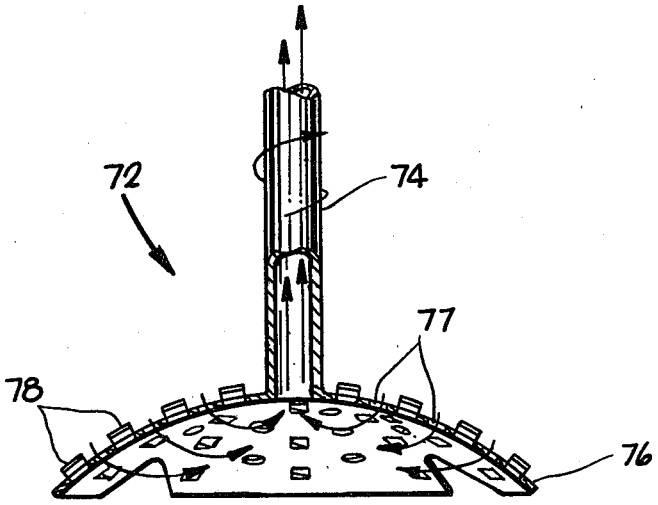
FIG. 3 shows a side view of a raised drill head according to the invention utilized in producing the rubblized filled cavities.
Figure 4:
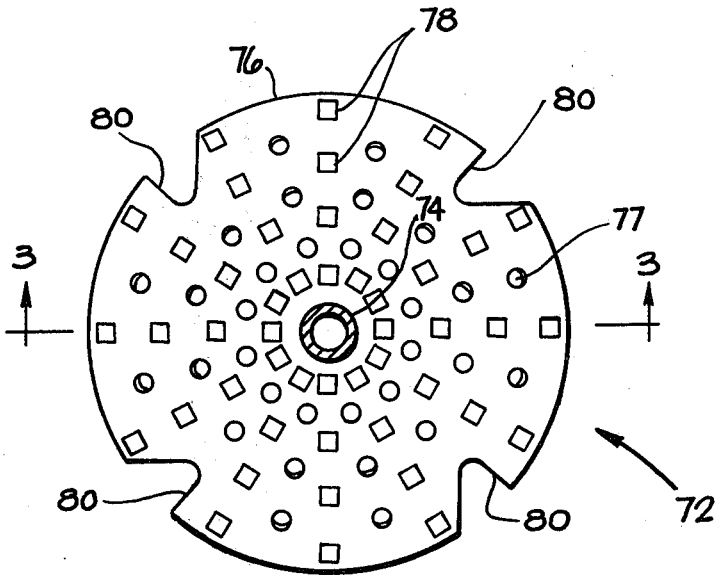
FIG. 4 is a top view of the raise drill head illustrated in FIG. 3.

A raise drill head 72, shown in FIGS. 3 and 4, according to the invention, the can be utilized in the raise reaming operation includes a central drive shaft 74 and a body 76 connected to the drive shaft 74. The body has a generally circular base, typically of about 7 m diameter, and a sloping upper surface, generally hemispherical or conical in shape. Mounted upon and protruding from the body section 76 are a plurality of cutter teeth 78 for contacting the oil shale and breaking pieces loose from the formation. The cutter teeth 78 are carbide and preferably spaced about 6 inches apart.

In operation, the central drive shaft 74 is attached to a raise drill string extending through the pilot hole. As the raise drill head 72 is rotated and pulled up through the oil shale deposit, typically at a rate of about 3 m/hr, the cutter teeth 78 break off pieces of oil shale, thereby reaming out a cavity around the pilot hole and breaking up the oil shale deposit into rubble containing relatively uniform sized larger pieces plus fines or small particles. The central drive shaft 74 and the body 76 are hollow, and a plurality of relatively small holes 77 are formed in the body 76 between the cutter teeth 78. A flushing fluid, preferably air, is circulated through the raise head 72 and upward through the raise drill string to provide removal of fines generated during the raise reaming operation. The fines removal can be performed by placing suction on the hollow central drive shaft 74 through the attached drill string. Air flows down through the pilot hole and carries the lightweight fines through the holes 77 in hollow body 76 and up the central drive shaft so they are removed from the cavity. This removes a sufficient volume of the material to allow the remaining material to substantially fill the cavity with sufficient void space. The air flow also cools the raise drill head.

The body 76 of the raise head contains a plurality of relatively large peripheral chip removal cutouts or flutes 80 for allowing the larger pieces to fall below into the cavity being produced. Bigger pieces are contained above the raise head and further broken up to produce sizes that can fall through the cutouts 80, thereby assuring that the sizes will be relatively uniform. As the raise head 72 rotates and moves upward, the fines and small sized particles are flushed out, and the larger uniformly sized pieces fall through the cutouts 80 into the rubblized bed that fills the cavity.

Changes and modifications in the specifically described embodiments can be carried out without departing from the scope of the invention which is intended to be limited only by the scope of the appended claims.

I claim:

1. A method of producing in an underground formation a cavity filled with a bed of uniform rubblized material, comprising:

forming a substantially vertical pilot hole in the underground formation;

reaming the pilot hole into a cavity, thereby forming fines and rubblized material; and drawing a flushing fluid out of the cavity to carry away the fines, leaving a bed of rubblized material in the cavity.

2. The method of claim 1, further including the step of forming a pair of aligned horizontal drifts through the underground formation.

3. The method of claim 2, wherein the pilot hole is formed between the horizontal drifts.

4. The method of claim 1 or 3, wherein the step of reaming the pilot hole is performed by rotating and raising a large diameter raise drill head through the pilot hole.

5. The method of claim 4, wherein the step of reaming the pilot hole is performed by rotating and raising a hollow body having a plurality of cutter teeth mounted thereon and a hollow shaft attached thereto, the hollow body having a plurality of relatively small holes for allowing the flushing fluid to flow from the cavity into the hollow body and a plurality of relatively large peripheral flutes for allowing the rubblized material to drop into the cavity below the raise drill head.

6. The method of claim 5, wherein the flushing fluid is air.

7. The method of claim 6, wherein the step of drawing the flushing fluid is performed by attaching a source of suction to the hollow shaft and flowing air down the pilot hole to carry fines into the hollow body through the holes in the body and out through the hollow shaft and to cool the raise drill head.

8. A method of producing shale oil from an oil shale deposit, comprising the steps of:

drilling at least one substantially vertical pilot hole in the oil shale deposit;

reaming the pilot hole into an enlarged cavity, thereby producing rubblized oil shale and oil shale fines;

drawing a flushing fluid out of the cavity to withdraw the oil shale fines, leaving a bed of rubblized oil shale in the cavity;

heating the rubblized oil shale in the cavity to produce shale oil; and withdrawing the shale oil from the cavity.

9. The method of claim 8 wherein the step of reaming the pilot hole is performed by rotating and raising a large diameter raise drill head through the pilot hole.

10. The method of claim 9 wherein the step of reaming the pilot hole is performed by rotating and raising a hollow body having a plurality of cutter teeth mounted thereon and a hollow shaft attached thereto, the hollow body having a plurality of relatively small holes for allowing the flushing fluid to flow from the cavity into the hollow body and a plurality of relatively large peripheral flutes for allowing the rubblized material to drop into the cavity below the raise drill head.

11. A raise drill head for producing in an underground formation a cavity filled with a bed of rubblized material, comprising:

a hollow body having a substantially circular base and sloping upper surface;

a plurality of spaced cutter teeth mounted on the upper surface of the body, the body having a plurality of spaced relatively small holes located between the cutter teeth to flush out fines from the cavity when suction is applied to the hollow body, the body also having a plurality of relatively large peripheral flutes spaced around the base to allow rubblized material to drop into the cavity below the raise drill head; and a hollow shaft attached to the hollow body and opening into the hollow body.

12. The raise drill head of claim 11 wherein the upper surface is substantially convex in shape.

13. The raise drill head of claim 12 wherein the upper surface is substantially hemispherical in shape.

14. The raise drill head of claim 11 wherein the upper surface is substantially conical in shape.

* * * * *